US006969181B1

(12) United States Patent
Bailey et al.

(10) Patent No.: US 6,969,181 B1
(45) Date of Patent: Nov. 29, 2005

(54) FULLY RECESSED UNIT EQUIPMENT LUMINAIRE

(75) Inventors: Glenn Eric Bailey, Wilmington, NC (US); Robert J. Riffel, Wilmingotn, NC (US); David Jenkins, Chapel Hill, NC (US)

(73) Assignee: Genlyte Thomas Group LLC, Louisville, KY (US)

( * ) Notice: Subject to any disclaimer, the term of this patent is extended or adjusted under 35 U.S.C. 154(b) by 424 days.

(21) Appl. No.: 09/851,367

(22) Filed: May 8, 2001

(51) Int. Cl.[7] ..... F21V 15/01; F21V 17/00

(52) U.S. Cl. ..... 362/364; 362/362; 362/147; 362/368

(58) Field of Search ..... 362/362, 147, 362/368, 389, 319, 321, 324, 287, 364, 20, 362/342, 148, 260, 153, 296, 297, 301, 310, 362/341, 267

(56) References Cited

U.S. PATENT DOCUMENTS

| | | | | |
|---|---|---|---|---|
| 1,225,032 A | | 5/1917 | Hotchkin | |
| 1,350,295 A | | 8/1920 | Champeau | |
| 1,577,112 A | | 3/1926 | Cushing | |
| 1,598,106 A | | 8/1926 | Schoonmaker | |
| 2,112,147 A | | 3/1938 | Downer | |
| 2,887,568 A | | 5/1959 | Franck | |
| 3,502,865 A | | 3/1970 | Matteson | |
| 3,634,674 A | | 1/1972 | Tuttle | |
| 3,643,089 A | | 2/1972 | Marantz | |
| 3,700,877 A | | 10/1972 | Wilson | |
| 3,732,417 A | | 5/1973 | Nordquist | |
| 3,978,331 A | | 8/1976 | Paparodis | |
| 4,158,223 A | | 6/1979 | Walley et al. | |
| 4,159,511 A | | 6/1979 | Dejone | |
| 4,177,500 A | * | 12/1979 | Nicholl et al. | 362/20 |
| 4,231,080 A | * | 10/1980 | Compton | 362/298 |
| 4,261,028 A | | 4/1981 | Adam | |
| 4,337,507 A | | 6/1982 | Lasker | |
| 4,354,221 A | | 10/1982 | Hoffmann | |
| 4,386,392 A | | 5/1983 | Reibling | |
| 4,408,266 A | | 10/1983 | Sclippa | |
| 4,422,134 A | | 12/1983 | Brass | |
| 4,450,513 A | | 5/1984 | Guggemos | |
| 4,475,147 A | | 10/1984 | Kristofek | |
| 4,480,291 A | | 10/1984 | Dranginis | |
| 4,519,019 A | | 5/1985 | Hall | |
| 4,614,996 A | * | 9/1986 | Enaka et al. | 362/147 |
| 4,623,956 A | | 11/1986 | Conti | |
| 4,701,832 A | | 10/1987 | Lasker | |
| 4,729,075 A | * | 3/1988 | Brass | 362/217 |
| 4,760,507 A | | 7/1988 | Lasker et al. | |
| 4,768,140 A | | 8/1988 | Szpur | |
| 4,796,169 A | | 1/1989 | Shemitz | |
| 4,802,065 A | | 1/1989 | Minter et al. | |
| 4,860,182 A | | 8/1989 | Vadseth | |

(Continued)

*Primary Examiner*—Sandra O'Shea
*Assistant Examiner*—B Q Truong
(74) *Attorney, Agent, or Firm*—Middleton Reutlinger

(57) ABSTRACT

A fully recessed unit equipment luminaire for providing emergency lighting to a path of egress. The luminaire has batteries, a battery box, a housing, a charger/emergency switching circuit mounted on a chassis, lamps, reflector assemblies, and a cover. The luminaire may be configured for either wall or ceiling mounting with the use of wall or ceiling mount lenses, respectively. Reflector assemblies supporting the lamps are rotatably engaged by the cover. Each reflector assembly has a substantially semi-frustoconical shape and intersects the lamp's conical shaped beam of light to redirect the beam into a narrow, elongated pattern. The reflector assemblies may have a plurality of planar reflecting surfaces which approximate the semi-frustoconical shape.

30 Claims, 11 Drawing Sheets

U.S. PATENT DOCUMENTS 4,885,666 A * 12/1989 Yu ..... 362/189
4,954,935 A 9/1990 Hammond et al.
5,140,301 A 8/1992 Watanabe
5,146,248 A 9/1992 Duwaer et al.
5,217,299 A 6/1993 Yoshida et al.
5,335,151 A 8/1994 Dahlberg
5,379,195 A 1/1995 Epstein
5,416,683 A 5/1995 McCarthy
5,426,575 A 6/1995 Richards
5,438,495 A 8/1995 Ahlen et al.
5,486,989 A * 1/1996 Compton ..... 362/291
5,676,448 A 10/1997 Urbaing
5,813,744 A 9/1998 Altebarmakian
5,816,694 A 10/1998 Ideker et al.
5,851,061 A 12/1998 Hegarty
6,019,477 A 2/2000 Wegrzyn et al.
6,027,231 A 2/2000 Fouke
6,042,251 A 3/2000 McCarthy et al.
6,045,232 A 4/2000 Buckmaster
6,050,708 A 4/2000 Roorda
6,082,031 A 7/2000 Heaton et al.
RE36,908 E 10/2000 Ling
6,164,802 A * 12/2000 Gromotka ..... 362/375
6,168,294 B1 1/2001 Erni et al.
6,170,967 B1 * 1/2001 Usher et al. ..... 362/394

* cited by examiner

FULLY RECESSED UNIT EQUIPMENT LUMINAIRE

BACKGROUND OF THE INVENTION

1. Field of the Invention

This invention relates to emergency lighting luminaires, and more particularly to self-contained unit equipment luminaires for recessed installation in a ceiling or wall.

2. Description of Prior Art

Adequate illumination of emergency egress routes from the interior of buildings is a requirement of nearly all modern building codes and standards. For instance, the National Fire Protection Association (NFPA) issues standards for emergency lighting illumination levels and uniformity ratio along the egress path.

The current NFPA Life Safety Code requires that "Emergency illumination shall be provided for a period of 1½ hours in the event of failure of normal lighting. Emergency lighting facilities shall be arranged to provide initial illumination that is no less than an average of 1 footcandle (10 lx) and a minimum at any point of 0.1 footcandle (1 lx) measured along the path of egress at floor level. Illumination levels may decline to 0.6 footcandle (6 lx) average and a minimum at any point of 0.06 footcandle (0.6 lx) at the end of the emergency lighting time duration. A maximum to minimum illumination uniformity ratio of 40 to 1 shall not be exceeded." NFPA Life Safety Code Section 5-9.2.1 One way that designers meet such standards is through the use of "unit equipment" luminaires, which generally consist of a self-contained rechargeable battery, battery charging circuitry, lamps, and circuitry for switching to battery power and illuminating the lamps upon the occurrence of an emergency condition, such as a power failure.

Traditionally, unit equipment luminaires have a housing which contains the electronic components. The luminaires typically are hung from a wall and the lamp adjusted as desired. Thus, such a unit equipment luminaire protrude into the living space of the room or corridor where they are located.

However, exposed unit equipment luminaires are not always compatible with the interior design of space. Additionally, such exposed luminaires are subject to both accidental abuse and intentional vandalism.

Emergency lighting designers have presumably attempted to address such issues with devices such as those described in U.S. Pat. Nos. 4,802,065, and 5,851,061.

For instance, U.S. Pat. No. 4,802,065 to Minter, et al., issued Jan. 31, 1989, teaches an emergency lighting fixture for mounting in a ceiling. The fixture has a drop down panel normally enclosing an opening in the ceiling. An energized solenoid or motor hold the panel in the closed position. A lamp is mounted to the drop down panel such that upon failure of a.c. power, the weight of the panel and lamp causes the panel and lamp to drop down to illuminate a path of egress. This design, while functional, has added energy, component and maintenance costs associated with the continuously energized solenoid or motor and the moving parts associated therewith. Additionally, this design will not work in a wall installation, since it must be oriented such that the weight of the panel and lamp will cause the panel to drop down.

U.S. Pat. No. 5,851,061 to Hegarty, issued Dec. 22, 1998, also teaches a recessed emergency light fixture having a hinged panel which normally covers the installation opening. Upon failure of the normal a.c. power to the fixture, a solenoid opens the panel, which has a mirrored rear surface.

Illumination from a lamp within the fixture is then reflected off of the mirrored surface to light a path of egress. This design provides for mounting in either a ceiling or wall, since the panel is opened by the solenoid rather that gravity. The design has added costs due to the additional components (solenoid and linkage) and the maintenance issues associated with those moving parts. Further, efficiency of the fixture in the event of a power failure is likely reduced by the power consumed by the solenoid in holding the panel in an open position.

SUMMARY OF THE INVENTION

Thus, it is an object of the present invention to provide a luminaire for adequately illuminating emergency egress routes from the interior of buildings in compliance with safety codes and standards.

It is a further object of the present invention to provide a fully recessed unit equipment luminaire.

It is yet a further object of the present invention to provide a unit equipment luminaire which may be fully recessed in either a wall or a ceiling and which is free from motors, solenoids, panels or lamps which must extend, open, rotate, or otherwise move in order to function in an emergency situation.

It is an even further object of the present invention to provide a unit equipment luminaire which directs illumination along a path of egress beyond the immediate vicinity of the device, and which provides adequate illumination levels and uniformity along the egress path for an adequate duration in the event of its activation.

These and other objects are achieved through a unit equipment luminaire for recessed mounting behind the plane of a wall or ceiling. The luminaire of the present invention has a housing mounted behind an opening in the wall or ceiling, a battery, a charging/emergency switching circuit electrically connected to said battery, a directional lamp mounted completely within the housing, and a cover mounted over the wall or ceiling opening having a opening to allow light to exit from housing. The directional lamp is aimed at the path of egress area and is selectively electrically connected to the battery through the charging/emergency switching circuit. A semi-frustoconical shaped reflector assembly may be utilized to channel illumination to the path of egress area. A louvered lens may be added to optimize the uniformity of the illumination. Additionally, the lamp and reflector assembly may be rotationally engaged by the cover, such that an alternate path of egress area may be illuminated by rotating the reflector assembly and directional lamp with respect to the cover. This may be particularly useful in a luminaire having dual lamps, whereby the lamps may by aimed at egress paths at angles to each other, such as a hallway corner.

Additional elements of the present invention include: a wall mount lens having a concave shaped collecting reflector which allows the luminaire to have a wall mount orientation; a housing and battery box assembly where the battery box is received in a housing opening and held in place by a housing flange in cooperation with wedge shaped lips and wedge shaped protuberances; a housing assembly further having a chassis for supporting the charger/emergency switching circuit which also isolates and secures the batteries; and breakaway tabs around the periphery of the front of the housing for pre- or post-sheet rock installation timing.

The elements outlined herein are given primarily for the purpose of better understanding of the present invention. Many additional inventive concepts will be understood herein and none of these objectives are to be considered as limiting without taking into consideration the entirety of the teachings of the figures and specification with together with the appended claims.

DESCRIPTION OF THE PREFERRED EMBODIMENT

Figure 1:
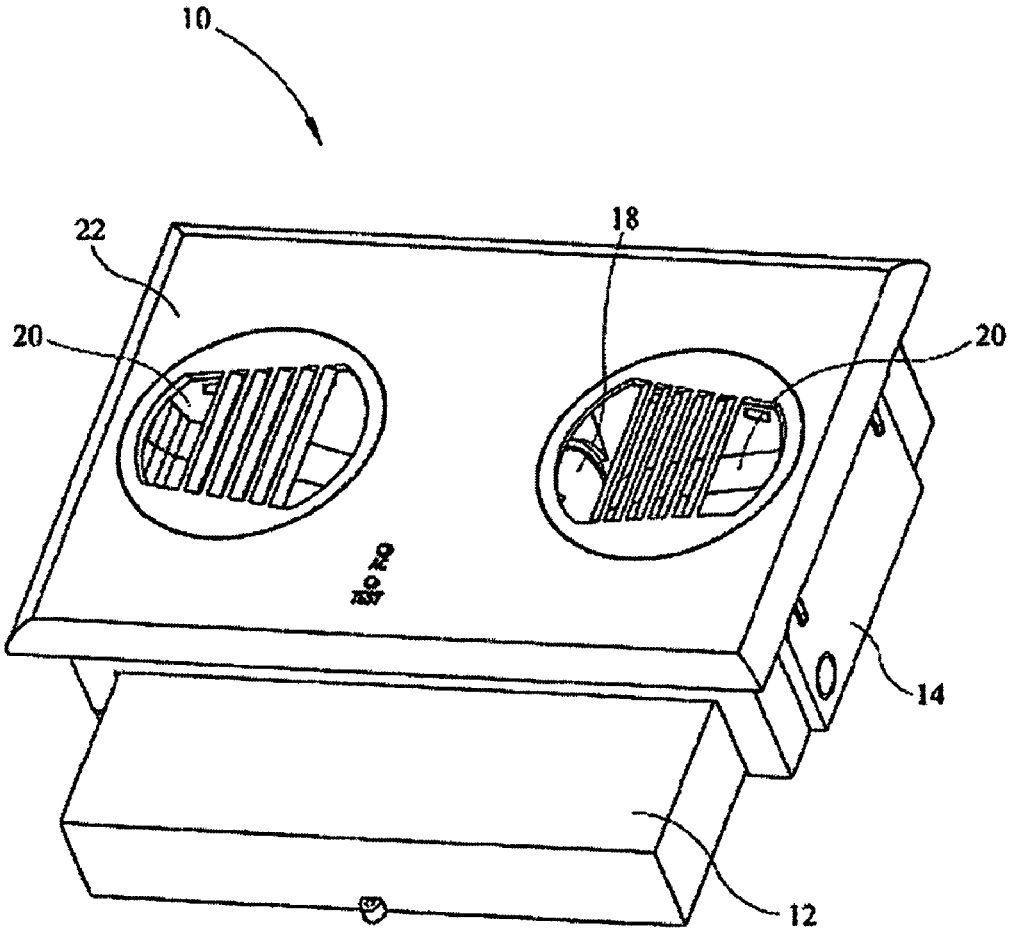
FIG. 1 shows a perspective view of a fully recessed unit equipment luminaire of the present invention.

A recessed unit equipment luminaire 10 of the present invention is shown in FIG. 1. As depicted therein, the cover 22 rotatably retains first and second reflector assemblies 20, which rotate within the housing 14. The reflector assemblies 20 may be independently rotated within the housing 14 such that the light emitted from the directional lamps 18 contained within the reflector assemblies 20 is directed to a user defined zone of illumination (ie. the path of egress). Additionally shown in FIG. 1 is the battery box 12 which extends outward from the housing 14, but is retained or otherwise securely affixed to the housing 14. Battery box 12 retains therein rechargeable batteries which energize the directional lamps 18 contained within the reflector assemblies 20 in the event of an emergency condition, such as a power failure or fire alarm. The recessed unit equipment luminaire 10 of the present invention, as depicted in FIG. 1, is shown such that it may be fully recessed within a ceiling or wall mounting, and which provides adequate illumination in the event of an emergency.

Figure 1A:
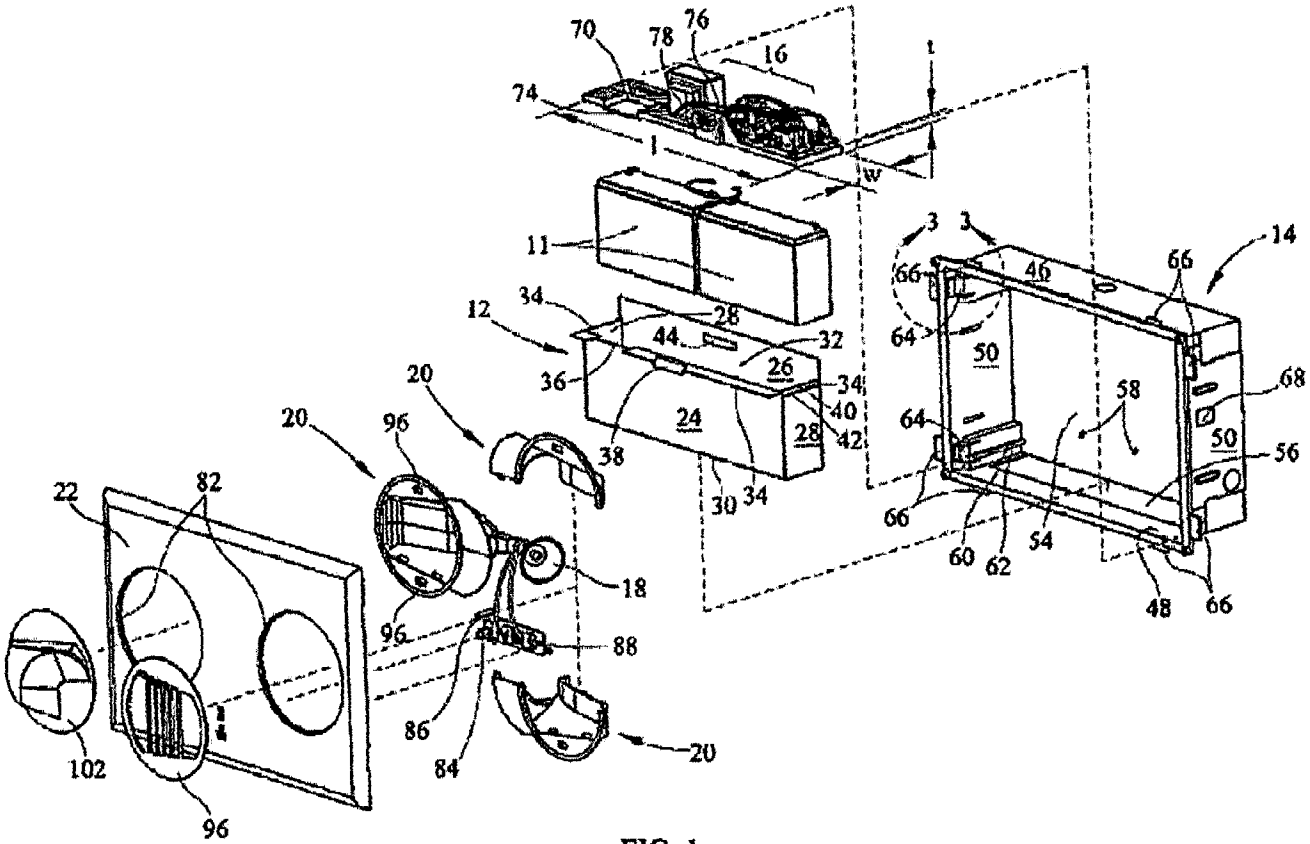
FIG. 1*a* shows an exploded perspective view of the luminaire of FIG. 1.

Shown in greater detail in FIG. 1*a*, the recessed unit equipment luminaire 10 of the present invention has batteries 11, a battery box 12, a housing 14, a charger/emergency switching circuit 16, directional lamps 18, reflector assemblies 20 and a cover 22.

The electrical configuration of the batteries 11 and charging/emergency switching circuit 16 are well known to those skilled in the art. The charging/emergency switching circuit 16 charges the batteries 11 when the unit equipment luminaire is operating under non-emergency conditions. Upon the occurrence of emergency conditions, such as a power failure or signal to the luminaire from a fire alarm or security system, the charging/emergency switching circuit 16 will activate the directional lamps 18 and operate them with power from the batteries 11, if necessary.

The unit equipment luminaire of the present invention utilizes, for example, two 35 watt MR16 directional lamps which operate off of maintenance free, sealed lead calcium batteries for a minimum of 90 minutes, but those skilled in the art will recognize that other electrical configurations may be utilized.

The housing 14, battery box 12, and cover 22 are preferably fabricated from a thermoplastic material which provides structural strength, thermal resistance, a degree of flexibility, and manufacturing and cost efficiencies.

Each of the individual elements shown in FIG. 1*a* will be herein described, but no unnecessary limitation is to be understood or interpreted in this description since variations and equivalent structure of the particular assemblies described are felt to be encompassed within the teachings hereof.

1. Batteries and Battery Box

As shown in FIG. 1*a*, the batteries 11 of the preferred embodiment are contained in the battery box 12, which has a front wall 24, a back wall 26, side walls 28 extending between the front wall 24 and back wall 26, a closed bottom 30, and an open top 32. Batteries 11 may be inserted into the battery box 12 through the open top 32. A flange 34 extends outwardly from the top edges of the front 24 and side 28 walls, with the exception of a small missing section 36 along the top edge of the front wall 24. The flange 34 and the top edges of the front 24 and side 28 walls are coplanar. A wedge shaped protuberance 38 extends outward and upward from the central front region of the flange 34 such that the top edge of the wedge shaped protuberance 38 is higher than the top surface of the flange 34. The side walls 28 each have a wedge shaped lip 40 extending outward such that a channel 42 is formed between the bottom of the flange 34 and the top of the wedge shaped lip 40. The back wall 26 extends above the top edges of the front 24 and side 28 walls, and has a mortise type slot 44 formed therein. The lower edge of the slot 44 is coplanar with the top of the flange 34. However, any implementation of a battery housing may be utilized in the present invention, and the teachings hereof are considered to incorporate such modifications.

2. Housing

Continuing with FIG. 1*a*, the housing 14 of luminaire 10 may be in the shape of a shallow rectangular box having top 46, bottom 48, side 50 and back 52 walls, and having an open front 54. The walls define a chamber having a volume of air providing sufficient heat diffusing properties, with the lamp configuration herein described, to potentially allow the luminaire to be rated as an IC (insulation contact) type recessed fixture. The housing bottom wall 48 has an opening 56 along the intersection of the back wall 54 and bottom wall 48. The lower portion of each housing side wall 50 has an inward projection 60 which is parallel with the housing bottom wall 48, thereby forming a channel 62 between each inward projection 60 and the housing bottom wall 48. Flexible fingers 64 are provided on the interior surfaces of each side wall 50 adjacent to each housing corner. Break-away tabs 66 extend outward from the front edge of each of the top 46, bottom 48, and side 50 walls adjacent to each corner. A sheet rock thickness gauge 68 is formed on the outside surface of each housing side wall 50, showing distance from the front surface of the housing 14.

Figure 2:
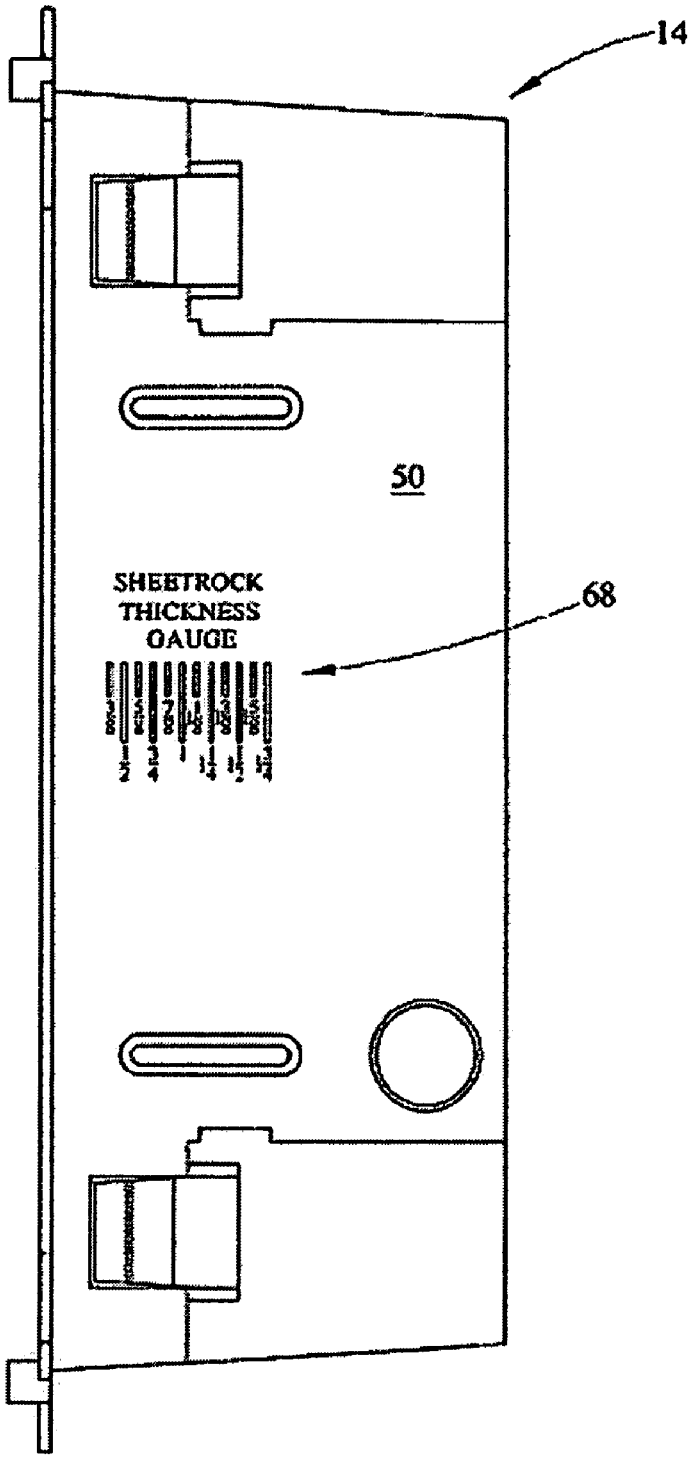
FIG. 2 shows a side view of the housing of the luminaire of FIG. 1.
Figure 3:
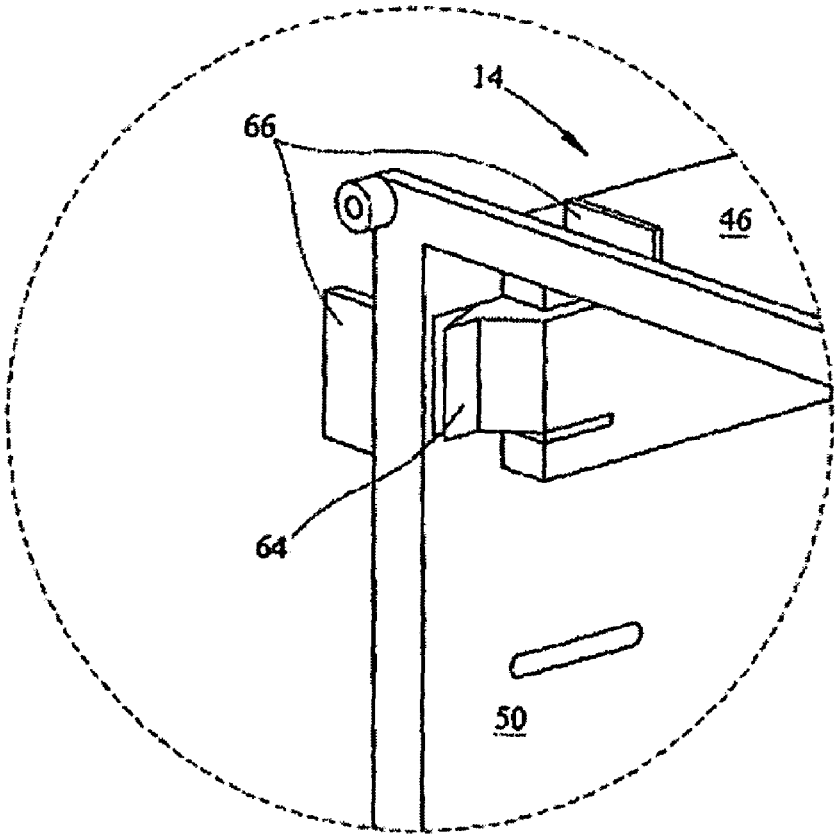
FIG. 3 is a partial perspective view of the area identified by line 3—3 of FIG. 1.

As shown in FIGS. 2 and 3, the tabs 66 and the thickness gauge 68 enhance installation of the luminaire by allowing for installation of the luminaire under varying construction conditions. Generally, two possible scenarios exist when installing recessed emergency luminaires. Specifically, either sheet rock walls and ceilings will already be installed, requiring forming an opening and installing the emergency luminaire, or, the emergency luminaire will be installed first, with the sheet rock to be installed later.

In the situation where the sheet rock in already in place, the opening will be created and the emergency luminaire inserted therein, with the tabs 66 stopping the unit from being pulled through the opening. Thus, the tabs will allow installation of the luminaire such that the housing open front 54 is flush with the room side of the sheet rock.

In the situation where the emergency luminaire will be installed prior to installation of the sheet rock, the luminaire must be installed with the front of the housing 14 protruding from the framework of the wall or ceiling an amount equal to the thickness of the sheet rock that will be installed, so that the housing open front 54 will be flush with the room side of the sheet rock when installed. Thus, the sheet rock thickness gauges 68 may used by an installer to mount the emergency luminaire with the proper thickness of the anticipated sheet rock. Further, since the sheet rock will necessarily require an opening to be placed over the luminaire, the break-away tabs 66 may be removed by simply breaking them off of the housing 14. Thus, the sheet rock will require only the smallest possible opening to fit over the housing 14.

Returning to FIG. 1*a*, the housing bottom wall opening 56 is sized to receive the battery box 12, such that the battery box 12 may be assembled to the housing 14 by placing the battery box 12 inside the housing 14 chamber, then allowing the battery box 12 to drop through the housing bottom wall opening 56 until the battery box side wall wedge shaped lips 40 contact the opening 56 edges. The materials of the preferred embodiment are resilient enough to allow the battery box lips 40 and the housing bottom wall 48 to yield to and slide past one another under force so that the battery box 12 may continue to be pushed through the housing bottom wall opening 56 until the bottom of the battery box flange 34 contacts the inner surface of the housing bottom wall 48 along the periphery of the opening 56. The battery box 12 is prevented from being lifted back into the housing 14 chamber by the top edges of the wedge shaped lips 40 acting against the outer surface of the housing bottom wall 48 along the side edges of the opening 56. Additionally, the housing of the preferred embodiment has several wedge shaped protuberances 58 extending inward from the back wall 52 oriented such that the bottom edges of the protuberances 58 engage the top edge of the battery box back wall 26 and further prevent the battery box 12 from being lifted back into the housing 14 chamber.

Figure 4:
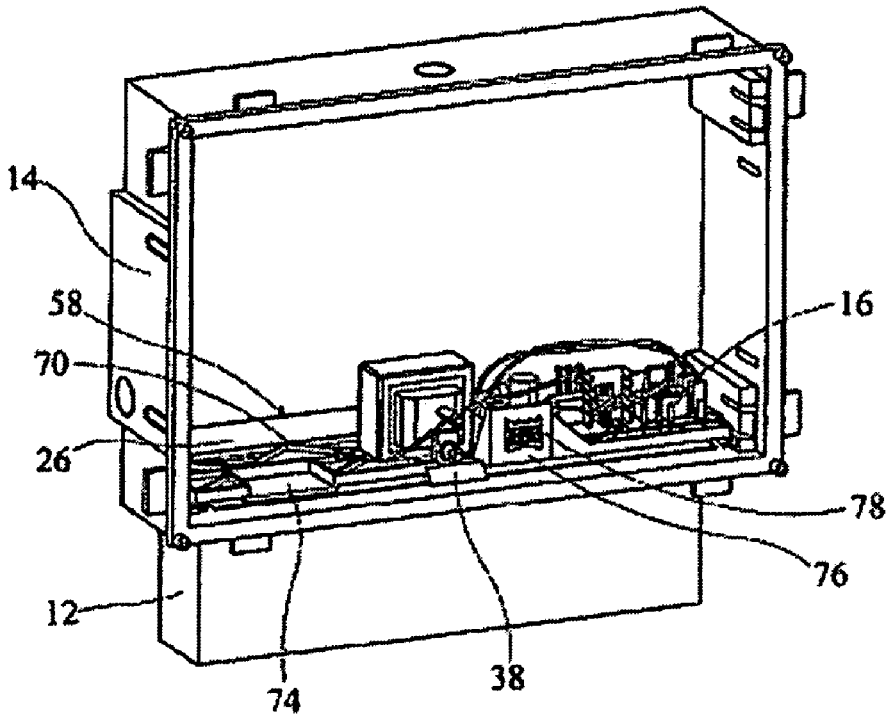
FIG. 4 is a perspective view of the assembled housing, battery box, and chassis (with charger/emergency switching circuit) of the luminaire of FIG. 1.
Figure 7:
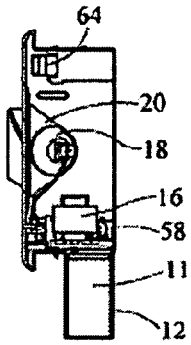
FIG. 7 is a side sectional view taken along line 7—7 of FIG. 6.

Thus, as shown in FIGS. 4 and 7, when assembled, the battery box 12 is attached to the housing 14 such that the battery box 12 (and the batteries 11) may be substantially outside of the housing 14 chamber, but accessible from the housing 14 chamber for maintenance, repair or replacement.

3. Charger/Emergency Switching Circuit and Charger Chassis

Returning again to FIG. 1*a*, charger/emergency switching circuit 16 sits on a chassis 70, generally having a length, l, and a width, w. The length, l, of the chassis 70 is slightly larger than the length of the battery box open top 32, but slightly smaller than the distance between the housing side walls 50. The width, w, of the chassis 70 is generally equal to the width of the battery box open top 32 plus the width of the flange 34. The thickness, t, of the chassis 70 is less than the height of the housing channels 62.

As shown in FIG. 4, assembly of the chassis 70 to the housing 14 is accomplished by inserting the chassis 70 edges into the channels 62 and pushing the chassis 70 into the housing 14 chamber. The chassis material is flexible enough to allow the chassis 70 to ride up and over the battery box wedge shaped protuberance 38. Once pushed all the way into the housing 14 chamber, the chassis 70 front edge will drop down behind the wedge shaped protuberance 38 edge, which will hold the chassis 70 in place against the housing back wall 52.

Additional features designed to hold the chassis 70 in place in the housing 14 chamber include a tenon type projection 72 along the back edge of the chassis 70 and a foot 74 depending from the front edge of the chassis 70. The tenon projection 72 is positioned to be in alignment with the battery box back wall mortise slot 44. Thus, when the chassis 70 is installed in the housing 14, the tenon projection 72 mates with the mortise slot 44 to hold the chassis 70 in position. The depending foot 74 is positioned to be in alignment with the small missing section 36 of the battery box flange 34 such that the foot 74 and the flange 34 further cooperate to stabilize and secure the chassis 70.

A wiring access opening (not shown) may be provided in the to allow electrical wiring to pass through the chassis 70 between the batteries 11 and the charger/emergency switching circuit 16.

Thus, the chassis 70 may be inserted into the housing 14 chamber along the channels 62, providing a toolless snap-fit, thereby securing the batteries 11 in the battery box 12. Additionally, the chassis 70 provides a thermal barrier for the batteries 11, which produces longer discharge times and extended battery life.

A power connector support 76 is formed along the front edge of the chassis 70. The power connector support 76 holds a power connector socket 78 in place facing the housing open front 54. The power connector socket 78 is electrically connected to the charger/emergency switching circuit 16, as further described herein.

4. Cover

Figure 5:
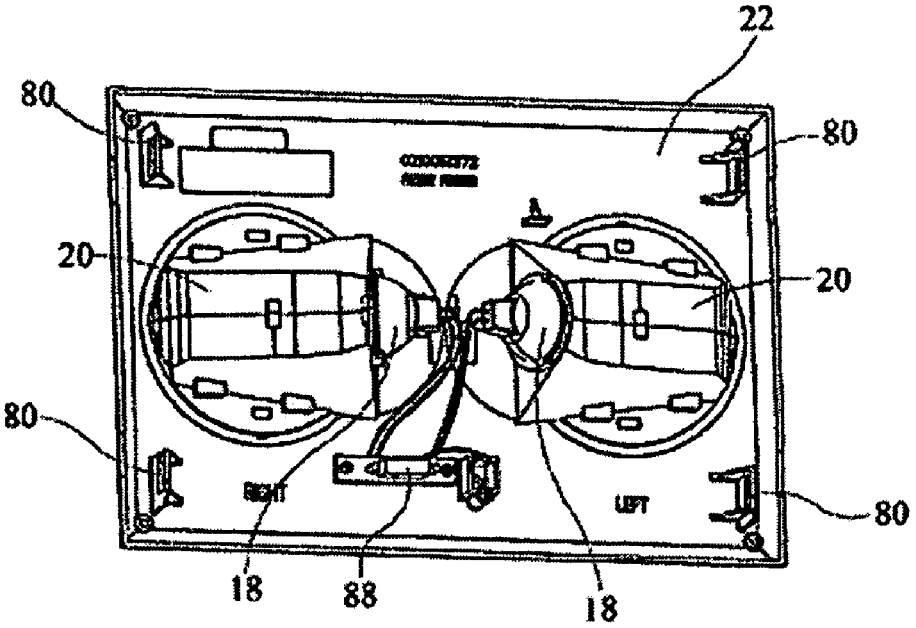
FIG. 5 is a perspective view of the back of the cover, with lamps and reflector assemblies of the luminaire of FIG. 1.
Figure 6:
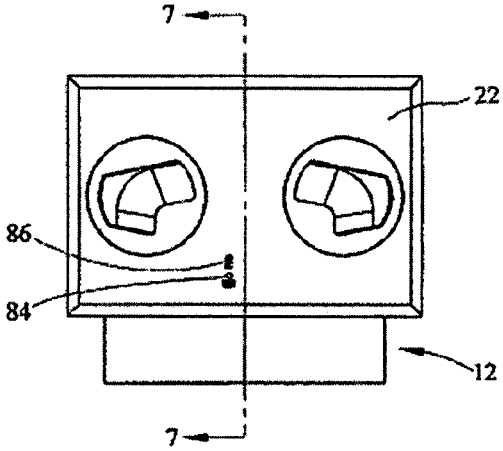
FIG. 6 is a front view of the luminaire of FIG. 1, with wall mount lenses installed thereon.

As shown in FIG. 5, the cover 22 supports the directional lamps 18 and reflector assemblies 20, and is designed to fit over the housing open front 54, providing a finished appearance to the unit equipment luminaire that is substantially flush with the ceiling or wall mounting surface in order to provide emergency lighting that is unobtrusive. The cover 22 of the preferred embodiment may be painted, wall papered, or otherwise have surface treatment to match the scheme of the surrounding room decorations.

The cover 22 has loops 80 which extend from its back surface and are positioned in alignment with the housing flexible fingers 64. Thus, the cover 22 may be attached to the housing 14 without screws or other fasteners, and without any tools, by placing the cover 22 over the housing open front 54 and pushing until the housing flexible fingers 64 engage the cover loops 80. The cover 22 may be removed in a similar manner.

As best shown in FIG. 1*a*, the cover 22 has two circular openings 82 for receiving the reflector assemblies 20, a test button 84, a status indicator lamp 86, and a power connector plug 88. Cover power connector plug 88 is positioned in alignment with the power connector socket 78 on the chassis 70 such that when cover 22 is installed on housing 14, cover power connector plug 82 mates with chassis power connector socket. The directional lamps 18, test button 84, and status indicator lamp 86 are electrically connected to the cover power connector plug 88. Thus, appropriate electrical connections between the charger/emergency switching circuit 16 and the directional lamps 18, test button 84, and status indicator lamp 86 are made through the cover power connector plug 88 and the chassis power connector socket 78.

5. Lamp Assemblies: Lamps and Reflector Assemblies

Figure 8:
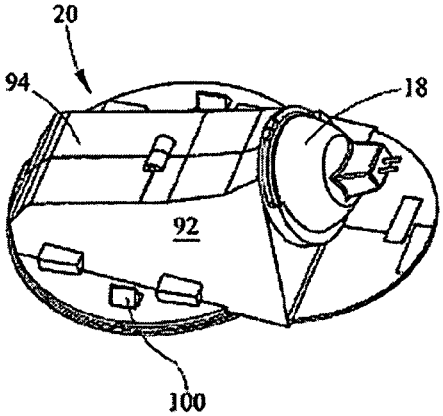
FIG. 8 is a perspective view of a lamp and reflector assembly of the luminaire of FIG. 1.

As shown in FIG. 8, directional lamps 18 and reflector assemblies 20 form lamp assemblies which are custom designed to optimize the light output of the luminaire for illumination of a path of egress. Each reflector assembly 20 has a circular front edge 90 which is rotatably engaged by the cover 22 in the circular opening 82. One skilled in the art will recognize that there are numerous rotatable engagement methods, including bearings in a raceway or tongue and groove mechanisms. The rotatable relationship of the reflector assemblies 20 and the cover 22 of the invention allows the reflector assemblies 20 to be aimed in directions varying from 180 degrees (ie. both directions down a long straight hallway), as shown, to 90 degrees (ie. egress paths perpendicular to each other, as at a corner).

The directional lamps 18 of the invention are directional or projection type MR16 (multifaceted pressed glass reflector lamps) lamps. MR type lamps have tungsten-halogen capsules and infrared transmitting dichroic reflectors, and have been adapted from projection lamp designs. They project a conical shaped beam of light. The lamps of the preferred embodiment may have a 23 degree beam spread.

Figure 11:
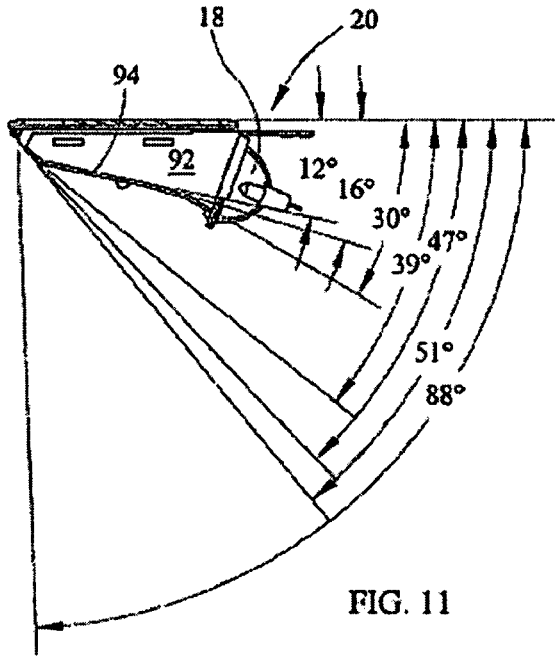
FIG. 11 is a side sectional view taken along line 11—11 of FIG. 9.

As shown in FIG. 11, the reflector assemblies 20 of the invention hold the directional lamps 18 at a fixed orientation, which has been predetermined to aim the light generally toward the center of the area of the path of egress from a ceiling mounting. In the preferred embodiment, this orientation is an inclination of approximately 20 degrees from the horizontal, designed for mounting in a standard height ceiling above the floor of the path of egress.

Figure 9:
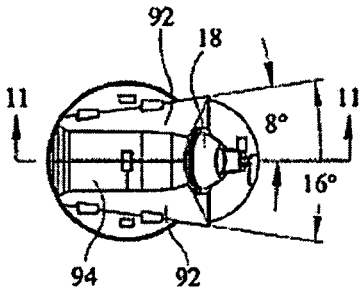
FIG. 9 is a top view of the lamp and reflector assembly of FIG. 8.
Figure 10:
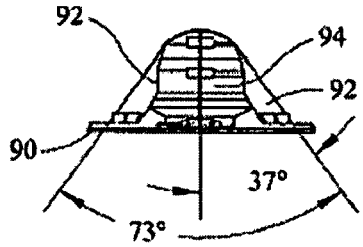
FIG. 10 is a side view looking from the narrow end toward the wide end of the reflector assembly of FIG. 8.

As seen in FIGS. 9 through 11, the reflector assemblies 20 of the present invention have a substantially semi-frustoconical or funnel shape oriented with the wide end proximate to the lamp, such that the conical shaped beam is intersected and redirected into a narrow, elongated pattern. The reflector assemblies 20 channel the illumination to the path of egress which would otherwise have been scattered onto areas outside the intended path.

Figure 12:
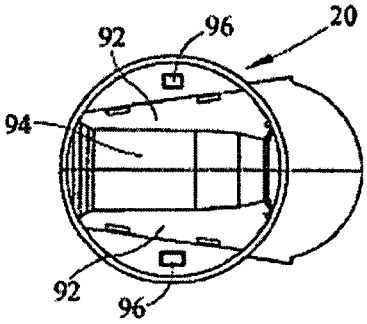
FIG. 12 is a bottom view of the reflector assembly of FIG. 8 without a lens installed thereon.

As shown in FIG. 12, the reflector assemblies 20 are comprised of a plurality of planar reflecting surfaces which approximate the semi-frustoconical shape. Side reflector sections 92 are located on the sides of each reflector assembly 20 and slope inward and downward, redirecting light into the elongated path of egress area. Further, central reflector section 94 also generally slopes downward and has a series of reflecting surfaces at varying angles which channel light to specific areas along the path of egress.

The reflector assemblies 20 also have lens fastener receiving openings 96 located adjacent to the side reflector sections 92 on the front face of the reflector assembly. Additionally, the entire reflector assembly 20 is slightly recessed from the surface of the cover 22.

6. Ceiling Mount Lens

Figure 14:
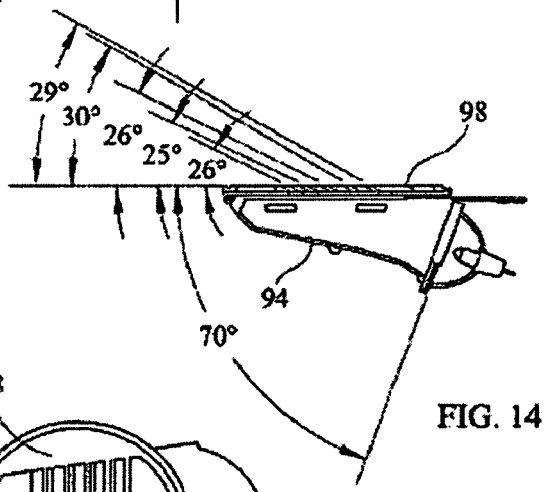
FIG. 14 is a side sectional view similar to the view of FIG. 11, but showing details of the louvers of a ceiling mount lens of the present invention.
Figure 13:
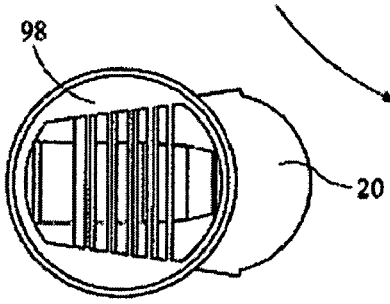
FIG. 13 is a bottom view of the reflector assembly of FIG. 8 with a ceiling mount lens installed thereon.
Figure 17:
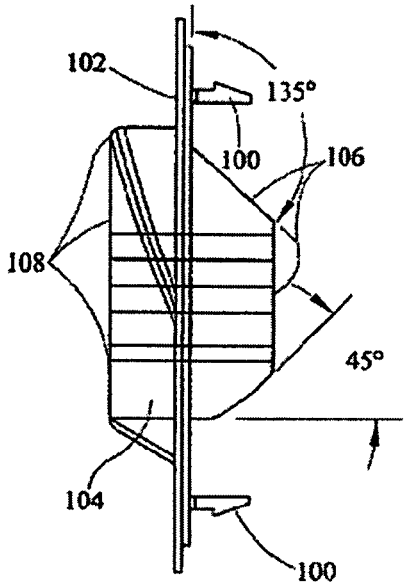
FIG. 17 is a side view of the wall mount lens of FIG. 16.
Figure 18:
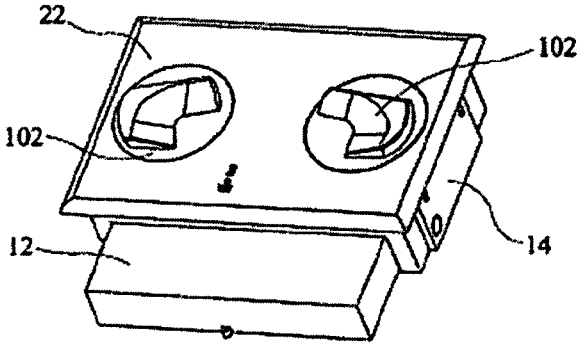
FIG. 18 is a perspective view of the luminaire of FIG. 1 having wall mount lenses installed thereon.
Figure 19:
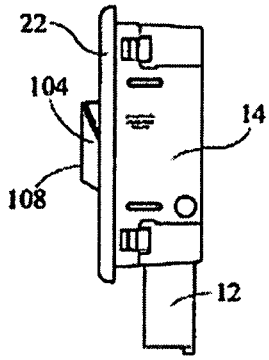
FIG. 19 is a side view of the luminaire of FIG. 18.

As shown in FIGS. 13 and 14, in order to fine-tune the light distribution pattern from the luminaire installed in a ceiling mount configuration, a louvered lens 98 may be added to each reflector assembly 20. The louvers of the louvered lens 98 have a reflective coating to provide additional redirection of light to achieve a more uniform light distribution along the path of egress area. The louvered lens 98 has hook shaped fasteners 100, observable in FIGS. 8 and 17, extending from its back side, which cooperate with the reflector assembly lens fastener receiving openings 96 to attach the lens to the reflector assembly 20. The circular shape of the louvered lens 98 matches the dimensions of the reflector circular front edge 90 and the cover circular opening 82 and seats onto the reflector assembly 20 to be flush with the surface of the cover 22. Thus, the louvered lens 98 is free to rotate along with its respective reflector assembly 20.

Figure 15:
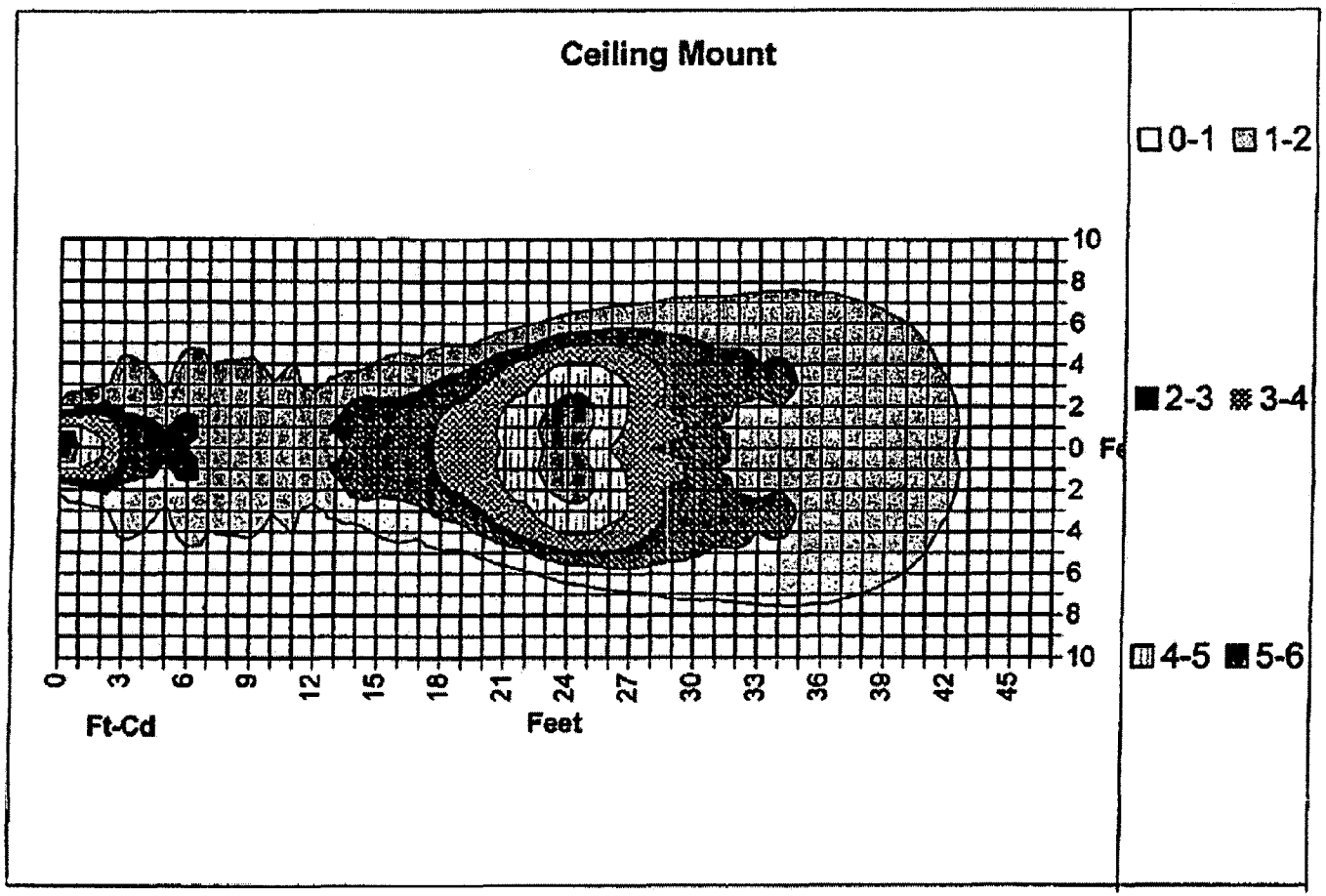
FIG. 15 is a photometry chart of the luminaire of the present invention with ceiling mount lens configuration and luminaire orientation.
Figure 16:
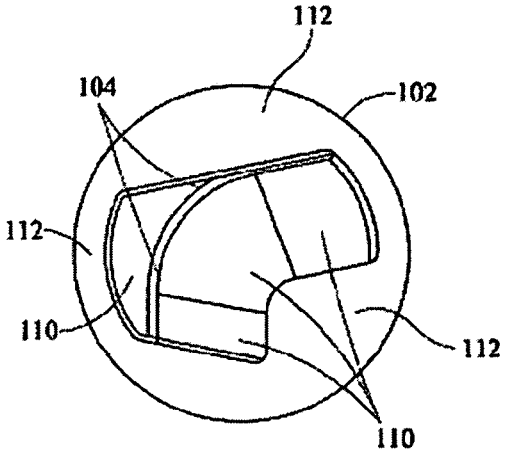
FIG. 16 is a front view of a wall mount lens of the present invention.

FIG. 15 is a photometric chart of the performance of a single lamp assembly of the luminaire configured with a ceiling mount lens and installed in a ceiling mount orientation. As shown, the luminaire provides adequate and substantially uniform illumination along an area extending from directly beneath the luminaire to a point over 42 feet from the luminaire.

7. Wall Mount Lens

As shown in FIGS. 16 through 19, for use in a wall-mount configuration, a wall mount lens 102 may be utilized in conjunction with each reflector assembly 20 to direct light from the luminaire downward and outward without having to alter the directional lamp 18 or reflector assembly 20 orientation. This is accomplished through the use of a collecting reflector 104. The collecting reflector is generally concave shaped, having a shallow horizontal outward extension from the top of the wide end of the frustoconical shaped reflector assembly 20 and having its inner edge 106 follow the curvature of the upper side reflector section 92 and central reflector section 94 toward the lower distal corner of the reflector assembly 20 while the outer edge 108 retains its constant shallow outward extension from the front surface of the reflector assembly 20. The collecting reflector 104 of the preferred embodiment has contiguous planar reflecting surfaces, with each surface being designed to direct light to a predetermined location along the path of egress area. Thus, light which is channeled to an elongated area shape by the reflector assembly 20 is redirected by the collecting reflector 104 in a direction opposite to the direction of the directional lamp 18 and downward out of the luminaire. The wall mount lens also has a clear lens portion 110 that tapers up from the surface level of the cover 22 to the outer edge 108 of the collecting reflector 104. A mask portion 112 of the wall mount lens 102 is coated with a reflective material on the inside surface of the lens to shield unwanted light and redirect it back into the reflective chamber formed by the reflector assembly 20 and the wall mount lens 102.

Figure 20:
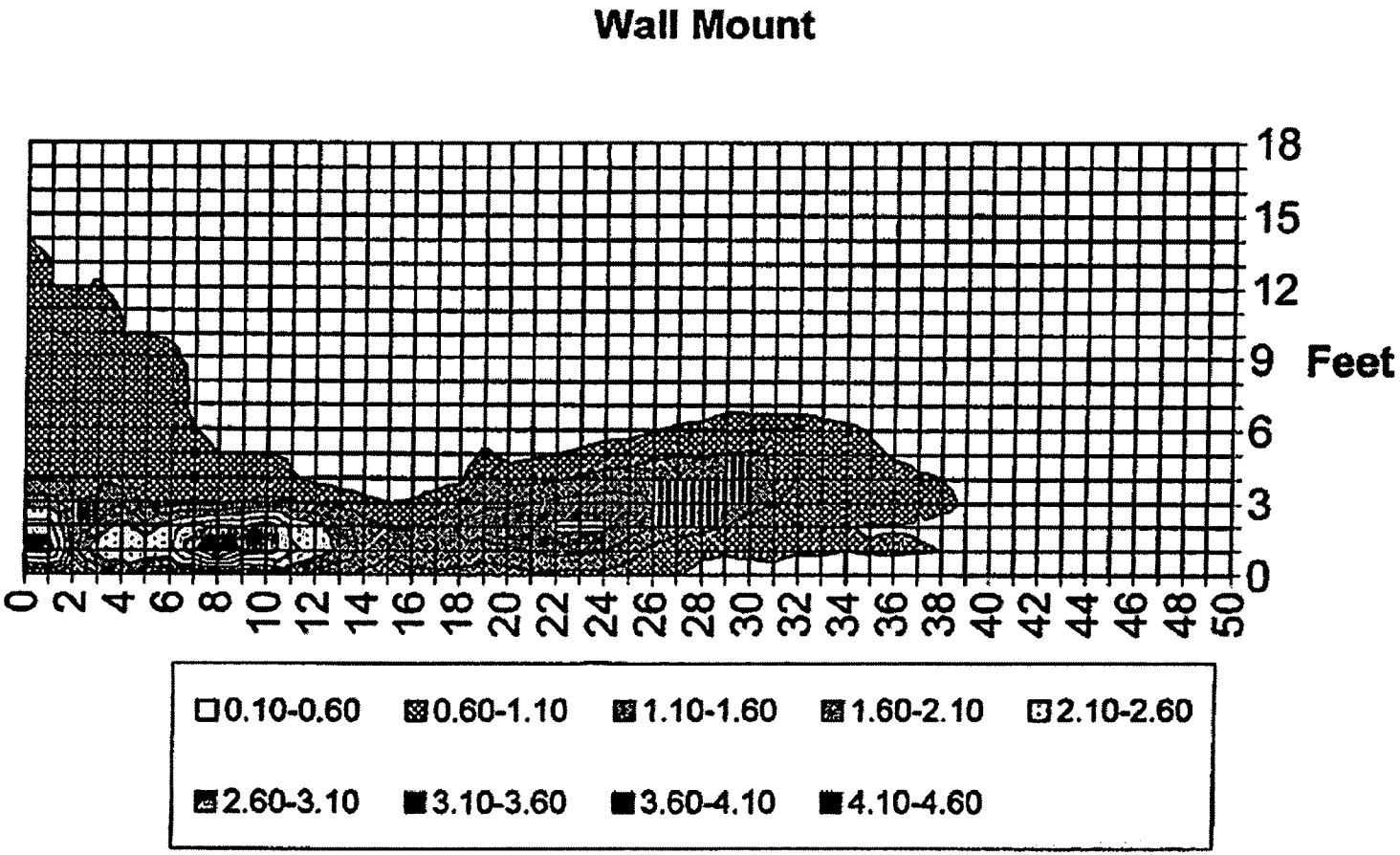
FIG. 20 is a photometry chart of the luminaire of the present invention with wall mount lens configuration and luminaire orientation.

FIG. 20 is a photometric chart of the performance of a single lamp assembly of the luminaire configured with a wall mount lens and installed in a wall mount orientation. As shown, the luminaire provides adequate and substantially uniform illumination along an area extending from directly beneath the luminaire to a point over 38 feet from the luminaire.

8. Plenum Rated Ceiling Enclosures

Figure 21:
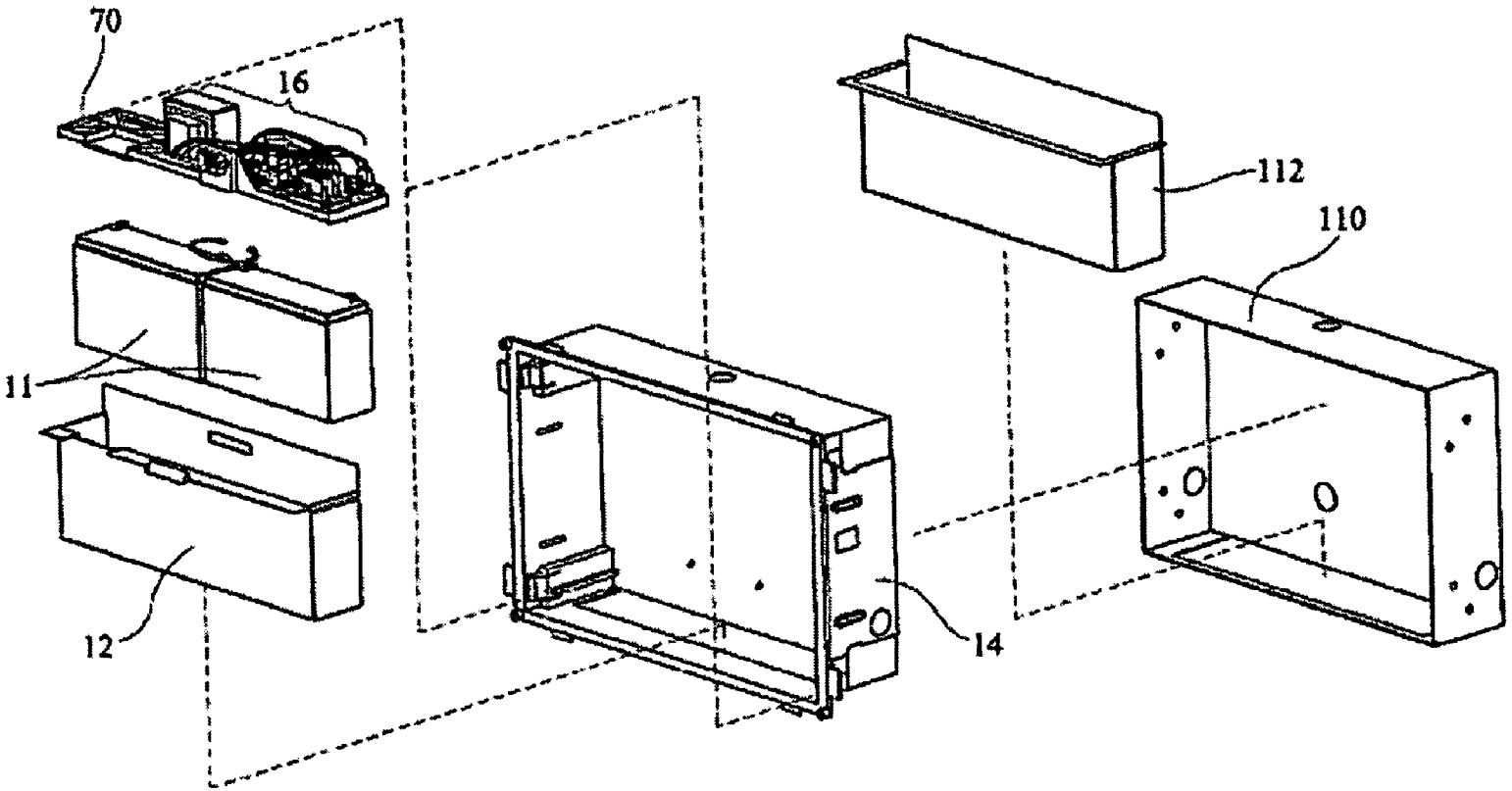
FIG. 21 is an exploded perspective view of the luminaire of the present invention as used with plenum rated ceiling enclosures.

As shown in FIG. 21, a sheet metal housing cover 110 and a sheet metal battery box cover 112 may be added to the housing 14 and battery box 12 to meet additional code and standards requirements for use of the recessed unit equipment luminaire 10 in plenum rated ceilings. In the event such a configuration is utilized, the housing 14, battery box 12, batteries 11, and chassis 70 are assembled together as described. Additionally, the sheet metal housing cover 110 and the sheet metal battery box cover 112 are assembled together as shown. Then the assembled components of the luminaire are received within the assembled cover components for installation.

This detailed description of the preferred embodiment, including specific angles and dimensions, shall not be construed as a limitation of the following claims, as it will be readily apparent to those skilled in the art that design choices may be made changing the configuration of the luminaire without departing from the spirit or scope of the invention.

What is claimed is:

1. A recessed unit equipment luminaire comprising:

a housing and a cover fitting over said housing to form an interior space in said housing, said cover having an opening to allow light from a directional lamp to be directed therethrough, said cover fitting over said housing such that said recessed equipment luminaire may be mounted behind a flat surface with only said cover visible;

a battery;

a charging/emergency switching circuit electrically connected to said battery; and a reflector assembly mounted to said cover and extending into said interior space of said housing, said reflector assembly having a reflective surface which redirects a portion of the light emitted from said directional lamp, said reflector assembly being substantially semi-frustoconical in shape and oriented partially around said directional lamp with a wide end proximate to said directional lamp, said directional lamp having a light source and a reflectorized bowl, said directional lamp being electrically connected to said battery through said charging/emergency switching circuit.

2. The unit equipment luminaire of claim 1 wherein said reflector assembly has a plurality of planar reflecting surfaces which approximate said semi-frustoconical shape.

3. The unit equipment luminaire of claim 2 wherein said reflector assembly has a central reflector section and side reflector sections, said central reflector section sloping downward from the top of said directional lamp to said cover opening, said side reflector sections located on either side of said central reflector section, said side reflector sections sloping downward and outward from said central reflector section to said cover opening.

4. The unit equipment luminaire of claim 3 wherein said central reflector section has a plurality of reflecting surfaces which redirect light to specific regions.

5. The unit equipment luminaire of claim 1 further having a louvered lens placed in the light path between said directional lamp and said cover opening.

6. The unit equipment luminaire of claim 1 wherein said cover opening is circular, said reflector assembly is in a fixed relation with said directional lamp, and said reflector assembly further has a circular front edge which is rotatably engaged by said cover along said circular cover opening, rotation of said reflector assembly changes the focal point of said directional lamp.

7. The unit equipment luminaire of claim 5 further having:

a second directional lamp mounted within said housing, said second directional lamp being electrically connected to said battery through said charging/emergency switching circuit;

a second reflector assembly mounted within said housing and extending into said interior space of said housing, said reflector assembly having a circular front edge and a reflective surface which redirects a portion of the light emitted from said second directional lamp;

said cover further having a second circular opening which rotatably engages said second reflector assembly circular front edge.

8. An emergency lighting system recessed behind a flat surface for illuminating a conical shaped area comprising:

a housing;

a directional lamp mounted within said housing, said directional lamp being aimed at said conical shaped area;

a cover having an opening to allow light from said directional lamp to be directed toward said conical shaped area mountable to said housing such that said housing may be mounted recessed behind a flat surface with said cover substantially aligned with said flat surface; and a reflector assembly mounted within said housing, said reflector assembly being substantially semi-frustoconical in shape oriented with a wide end proximate to said directional lamp and having a reflective surface which redirects a portion of the light emitted from said directional lamp toward said conical shaped area, said cover opening is circular, said reflector assembly is in a fixed relation with said directional lamp, and said reflector assembly further has a circular front edge which is rotatably engaged by said cover along said circular opening, whereby an alternate area may be illuminated by rotating said reflector assembly and said directional lamp with respect to said cover.

9. The emergency lighting system recessed behind a flat surface of claim 8 wherein said reflector assembly has a plurality of planar reflecting surfaces which approximate said semi-frustoconical shape.

10. The emergency lighting system recessed behind a flat surface of claim 9 wherein said reflector assembly has a central reflector section and side reflector sections, said central reflector section sloping downward from the top of the directional lamp to the cover opening, said side reflector sections located on either side of said central reflector section, said side reflector sections sloping downward and outward from said central reflector section to said cover opening.

11. The emergency lighting system recessed behind a flat surface of claim 10 wherein said central reflector section has a plurality of reflecting surfaces which direct light to specific regions in said conical shaped area.

12. The emergency lighting system recessed behind a flat surface of claim 8 further having a louvered lens placed in the light path between said directional lamp and said cover opening.

13. A unit equipment luminaire for recessed mounting behind the plane of a wall for illuminating a path of egress area comprising:

a housing mounted behind an opening in the plane of the wall;

a battery;

a charging/emergency switching circuit electrically connected to said battery;

a substantially semi-frustoconical reflector assembly having a wide end and an narrow end;

a wall mount lens including a collecting reflector depending toward said housing;

a directional lamp mounted within said housing, said directional lamp being located at said reflector assembly wide end and aimed generally toward said collecting reflector, said directional lamp being electrically connected to said battery through said charging/emergency switching circuit; and a cover mounted over said wall opening, said cover having an opening to allow light from said collecting reflector to exit said housing.

14. The unit equipment luminaire of claim 13 wherein said reflector assembly has a plurality of planar reflecting surfaces which approximate the semi-frustoconical shape.

15. The unit equipment luminaire of claim 14 wherein said reflector assembly has a central reflector section and side reflector sections, said side reflector sections located on either side of said central reflector section, said side reflector sections sloping outward from said central reflector section.

16. The unit equipment luminaire of claim 13 wherein said collecting reflector is concave shaped and extends from the top of said wide end of said reflector assembly to the bottom of said narrow end of said reflector assembly, said collecting reflector having an inner edge which follows the curvature of said reflector assembly and an outer edge which extends outward from said plane of the wall a distance proportional to the inward extension of said inner edge.

17. A unit equipment housing assembly comprising:

a shallow rectangular shaped housing having a bottom wall, and side walls, said bottom wall having an opening along the intersection of said bottom wall and said back wall, each side wall having an inward projections which is parallel with said housing bottom wall thereby forming a channel between said projection and said bottom wall;

a battery box having a front wall, a back wall, side walls extending between said front wall and said back wall, and an open top, a flange extending around the upper edge of the front and side walls, and a wedge shaped protuberance extending outward and upward from said flange, said back wall extending upward above the upper edge of the front and side walls and having a mortise type slot in said upward extension; and a thin rectangular chassis for supporting a charger/emergency switching circuit, said chassis having a tenon type projection along a back edge of the chassis;

said battery box being received within said housing bottom wall opening such that the bottom of said battery box flange contacts the inner surface of said housing bottom wall along the periphery of said bottom wall opening;

said chassis being received within said housing channels such that said a front edge of said chassis is held in place by the back edge of said battery box wedge shaped protuberance and said tenon projection mates with said mortise slot.

18. A housing for mounting behind the plane of a wall or ceiling, said housing comprising:

a front portion, said front portion to lie substantially in the plane of the wall or ceiling;

at least one side wall having a front edge lying along said front portion, said side wall having a thickness gauge formed on the outside surface thereof, said thickness gauge indicating distance from said front edge; and a plurality of break-away tabs located around the periphery of said front portion, said break-away tabs extending outward along the plane of said front portion.

19. A fully recessed unit equipment luminaire comprising:

at least one battery;

a battery box having walls for containing said battery and an opening for receiving said battery;

a shallow rectangular housing having walls defining a shallow rectangular chamber and an open front, one of said walls having an opening, said housing and said battery box being attached such that said housing wall opening is in alignment with said battery box opening;

a charger chassis having a charger/emergency switching circuit mounted thereto, said charger chassis being received within and attached to said housing over said battery box opening such that the said charger chassis provides a barrier between said housing chamber and said battery;

a directional lamp electrically connected to said battery through said charger/emergency switching circuit, said lamp also is received within said housing;

a cover closing said housing open front, said cover having a light exit aperture positioned to allow light from said lamp to illuminate an area external to said luminaire, and;

a wall mount lens including a collecting reflector depending toward said housing, said wall mount lens covers said light exit aperature and tapers up from a level surface of said cover to an outer edge of said collecting reflector.

20. A recessed unit equipment luminaire, comprising:

a housing, a battery, a switching circuit, a cover having a first and a second opening, a first reflector assembly in said first opening of said cover and a second reflector assembly in said second opening of said cover, said first and said second reflector assemblies being substantially semi-frustoconical in shape, said first reflector assembly has having a first directional lamp proximate to a wide end of said first reflector assembly and said second reflector assembly has having a second directional lamp proximate to a wide end of said second reflector assembly, said first and said second directional lamp electrically connected to said battery through said switching circuit.

21. The recessed equipment luminaire of claim 20 wherein said first and said second reflector assembly are rotateably mounted on said cover.

22. The recessed equipment luminaire of claim 21 wherein each of said first and said second reflector assemblies have a central reflector section and a first and second side reflector section, said central reflector section extending from said cover to said directional lamp, said first and second side reflector sections extending upwardly from said central reflector section to said cover opening.

23. The recessed equipment luminaire of claim 21 wherein said first and said second reflector assembly each have a wall mount lens including a collecting reflector formed therein.

24. A recessed unit equipment luminaire comprising a housing, a battery box retained in said housing, a switching circuit, a first and a second removable reflector assembly rotateably mounted on a cover attached to said housing, said first reflector assembly having a first substantially semi-frustoconical reflector formed therein, said second reflector assembly having a second substantially semi-frustoconical reflector formed therein, said first reflector assembly having a first directional lamp proximate a wide end of said first substantially semi-frustoconical reflector and said second reflector assembly having a second directional lamp proximate a wide end of said second substantially semi-frustoconical reflector, said first and said second directional lamp electrically connected to said battery by said switching circuit.

25. The luminaire of claim 24 wherein each of said first and said second reflector assembly has a wall mount lens with a generally concave collecting reflector extending to an exit aperture, said collecting reflector emitting light through said exit aperture in an elongated area shape.

26. The luminaire of claim 24 wherein said battery box is retained within an aperture in a side wall of said housing.

27. The luminaire of claim 24 wherein said cover further has a peripheral outer edge designed for recess mounting of said luminaire in a wall, said cover mounted on an exterior surface of said wall, said housing, battery box and switching circuit maintained on an interior surface of said wall.

28. A recessed unit equipment luminaire comprising:

a housing, wherein said housing has two shallow rectangular side walls, a top wall, a bottom, and a back wall, said bottom wall has an opening;

a cover having one or more circular openings wherein each opening has a rotatabley engaged frustoconical reflector assembly, said cover extending beyond each of said side walls, top wall and bottom; said reflector assembly having a directional lamp mounted therein so that a portion of said directional lamp is enshrouded by a wide end of said frustoconical reflector assembly; and a battery box engaging said housing around said opening in said bottom wall.

29. An emergency lighting system recessed into a wall for illuminating a conical shaped area on a floor comprising:

a housing;

a directional lamp mounted within said housing, said directional lamp being aimed at said conical shaped area;

a reflector assembly mounted within said housing, said reflector assembly being substantially semi-frustoconical in shape oriented with a wide end proximate to said directional lamp and having a reflective surface which redirects a portion of the light emitted from said directional lamp toward said conical shaped area, said conical shaped area being illuminated to at least 1 foot-candle and extending at least 30 feet horizontally from the vertical position of said emergency lighting system with respect to said floor.

30. An emergency lighting system recessed into a ceiling for illuminating a conical shaped area on a floor comprising:

a housing;

a directional lamp mounted within said housing, said directional lamp being aimed at said conical shaped area;

a reflector assembly mounted within said housing, said reflector assembly being substantially semi-frustoconical in shape oriented with a wide end proximate to said directional lamp and having a reflective surface which redirects a portion of the light emitted from said directional lamp toward said conical shaped area, said conical shaped area being illuminated to at least 1 foot-candle and extending at least 40 feet horizontally from the vertical position of said emergency lighting system with respect to said floor.

* * * * *